US005613599A

United States Patent [19]

Inagaki et al.

[11] Patent Number: 5,613,599

[45] Date of Patent: Mar. 25, 1997

[54] METHOD OF MANUFACTURING A FRAMED KEYTOP SHEET FOR A PUSH-BUTTON SWITCH

[75] Inventors: Jiro Inagaki, Tokyo; Atsushi Hari; Nobuyuki Kikuchi, both of Kanagawa-ken; Takashi Shinoki, Tokyo, all of Japan

[73] Assignee: Teikoku Tsushin Kogyo Co., Ltd., Kawasaki, Japan

[21] Appl. No.: 621,339

[22] Filed: Mar. 25, 1996

Related U.S. Application Data

[62] Division of Ser. No. 456,042, May 31, 1995, abandoned, which is a division of Ser. No. 138,065, Oct. 20, 1993, Pat. No. 5,475,192.

[30] Foreign Application Priority Data

Mar. 15, 1993 [JP] Japan ..... 5-080049
Mar. 16, 1993 [JP] Japan ..... 5-081366

[51] Int. Cl.[6] ..... H01H 1/10

[52] U.S. Cl. ..... 200/512; 200/517; 29/622

[58] Field of Search ..... 200/512, 513, 200/514, 520, 302.2, 293, 296, 341, 517; 29/622

[56] References Cited

U.S. PATENT DOCUMENTS 4,128,744 12/1978 Seeger .
4,536,625 8/1985 Bebie .
4,814,561 3/1989 Kawasaki .
4,839,474 6/1989 Hayes-Pankhurst et al. .
4,937,932 7/1990 Ishii ..... 29/622
4,980,522 12/1990 Murakami et al. .
5,020,215 6/1991 Tsai ..... 29/622
5,089,671 2/1992 Ranetkins .

FOREIGN PATENT DOCUMENTS 0483898 5/1992 European Pat. Off. .
0500330 8/1992 European Pat. Off. .
2219691 12/1989 United Kingdom .

*Primary Examiner*—David J. Walczak
*Attorney, Agent, or Firm*—Wenderoth, Lind & Ponack

[57] ABSTRACT

A keytop sheet of a push-button switch includes a keytop made of synthetic resin that is molded on a sheet of resin film. A portion of the film sheet surrounding the portion thereof on which the keytop is molded is provided with a curved projection protruding in a downward and/or upward direction from the surface of the film sheet. Such curved projection can be replaced by providing the portion of the film sheet surrounding the portion thereof on which the keytop is molded with a cut-out to form a hinge portion. A nameplate provided with a hole shaped so that the keytop may be passed therethrough is attached to the film sheet so as to cover the cut-out and hinge portion of the film sheet. The nameplate can have an outer diameter greater than that of the film sheet. A frame made of synthetic resin is fixed to an underside of the film sheet on an outer peripheral portion thereof. An outer peripheral portion of the nameplate is bent and fixed to an outer peripheral side surface of the frame.

6 Claims, 18 Drawing Sheets

A
L
L+ΔL
220
210
230
ΔL
0.1 mm
0.05 mm
(mm)
0.5 1.0 1.5 2.0 2.5 3.0 3.5 4.0 4.5 5.0 5.5 6.0 6.5 7.0
L
A'
ΔL
25° 20° 15° 10° 5°
A

METHOD OF MANUFACTURING A FRAMED KEYTOP SHEET FOR A PUSH-BUTTON SWITCH

This is a division of application Ser. No. 08/456,042 filed May 31, 1995, now abandoned, that is a division of application Ser. No. 08/138,065 filed Oct. 20, 1993, now U.S. Pat. No. 5,475,192.

BACKGROUND OF THE INVENTION

This invention relates to a method of manufacturing a framed keytop sheet for a push-button switch, such keytop sheet being of reduced size and thickness and being suitable for integration.

The reduction in the size and thickness of electronic devices that has been achieved in recent years has been accompanied by a demand to reduce the size and thickness also of a keytop sheet for push-button switches used in control panels of such devices.

In an effort to meet this demand, a keytop sheet has been proposed in which a plurality of keytops made of synthetic resin are fixedly molded to a film sheet comprising a single film made of resin, and a frame made of synthetic resin is fixedly molded to the periphery of the film sheet so as to encircle the plurality of keytops. A switch contact is disposed below each keytop so that if the keytop is pressed, the switch underlying it will be closed. At such time the film sheet surrounding the keytop is tensioned slightly in the downward direction. Push-button switches using a keytop sheet of this type include some that are used in environments in which there is the danger of humidity and moisture penetrating to the interior of the switch. In such case, there are instances in which it is preferred that the keytop sheet have a so-called waterproof structure in which humidity and moisture will not penetrate the underside of the sheet from the top side thereof. To achieve this, it is required that the film sheet be entirely devoid of holes.

When the conventional keytop sheet is such that the spacing between the keytops and the frame or the spacing between the keytops themselves is reduced for the sake of miniaturization, the following problems arise.

Specifically, FIGS. 20(A) and 20(B) show the relationship among an angle of inclination A of a film sheet 210, L and ΔL, where L represents the spacing between a keytop 220 and a frame 230 to which film sheet 210 has been affixed, and ΔL represents the amount by which the film sheet 210 must stretch when the keytop 220 is depressed by 0.3 mm. As indicated by the graph of FIG. 20(A), the smaller the spacing L, the much greater the amount of stretch ΔL and the angle of inclination A. In other words, the smaller the spacing L is made, the more difficult it is to depress the keytop 220. If the keytop 220 is pressed too strongly in such case, there is the danger that the film sheet 210 will be deformed.

Further, when any single keytop is pressed, a keytop alongside it is pulled slightly toward the pressed keytop. However, when the spacing between mutually adjacent keytops is made small, the amount of pull becomes much larger by reason of a principle similar to that described above in connection with FIG. 20. Consequently, when one keytop is pressed, there is the danger that the keytop alongside will be moved toward the pressed keytop to a noticeable extent.

If it is unnecessary to provide the keytop sheet itself with a waterproof function, then it will suffice to provide the portion of the film sheet surrounding each keytop with a C-shaped cut-out in order to solve the above-mentioned problem. If such an arrangement is adopted, the film sheet surrounding a keytop will not be pulled when the keytop is pressed, thereby facilitating operation of the keytop. However, when the film sheet is provided with a cut-out, the cut-out is visible from above the keytop sheet and detracts from the appearance of the device.

SUMMARY OF THE INVENTION

Accordingly, an object of the present invention is to provide a method of manufacture of a keytop sheet of a push-button switch having a simple structure in which each keytop can be pressed smoothly even if the keytop sheet is miniaturized.

Another object of the present invention is to provide such a method of manufacture of a keytop sheet of a push-button switch in which the keytop sheet itself can readily be provided with a waterproof structure as necessary.

A further object of the present invention is to provide such a method of manufacture of a keytop sheet in which an attractive external appearance is maintained even if the film sheet is provided with a cut-out.

According to the present invention, the above objects are achieved by providing a method of manufacture of a keytop sheet of a push-button switch in which a keytop arranged above a switch contact and having an underside provided with a pushing portion for opening and closing the switch contact by pressing it is molded at a prescribed position on a film sheet comprising a resin film, wherein the film sheet surrounding the portion thereof on which the keytop is molded is provided with a curved projection which protrudes in a downward and/or upward direction from the surface of the film sheet, so as to encircle the keytop. When the keytop is pressed to cause it to recede, the curved projection provided in the film sheet about the keytop is deformed, thereby making it easier to press the keytop.

According to another aspect of the present invention, the film sheet surrounding the portion thereof on which the keytop is molded is provided with a cut-out leaving a hinge portion, and a nameplate comprising a resin film and provided with a hole shaped so that the keytop may be passed therethrough is attached to the film sheet so as to cover the cut-out and hinge portion of the film sheet. In this aspect of the invention, the keytop is connected to the surrounding film sheet solely by the hinge portion, as a result of which the keytop can be pressed smoothly. Moreover, since the cut-out in the film sheet is covered by the nameplate, the cut-out cannot be seen from the surface and an attractive appearance is maintained as a result. Further, though the hinge portion develops a wrinkle when the keytop is pressed, the hinge portion also is covered by the nameplate so that the attractive appearance of the keytop sheet is maintained in this sense as well.

According to a further aspect of the present invention, a nameplate is mounted on the film sheet and comprises a resin film having an outer diameter greater than that of the film sheet, a frame made of synthetic resin is molded on an underside of the film sheet on a peripheral portion thereof so as to be affixed to the film sheet, and an outer peripheral portion of the nameplate that protrudes beyond the film sheet is bent and fixed to an outer peripheral side surface of the frame. Since the outer peripheral portion of the nameplate is thus fixed to the outer peripheral side surface of the frame, an upper edge portion on the outer periphery of the keytop sheet is covered by the nameplate. Therefore, even if the upper edge portion on the outer periphery of the keytop sheet protrudes somewhat from the surface of a case accommodating the keytop sheet, an attractive appearance in terms of design is maintained. Further, since the nameplate completely covers the film sheet and even extends up to the side face of the frame, the nameplate will peel off the film sheet only with great difficulty.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Preferred embodiments of the present invention will now be described in detail with reference to the accompanying drawings.

Figure 1:
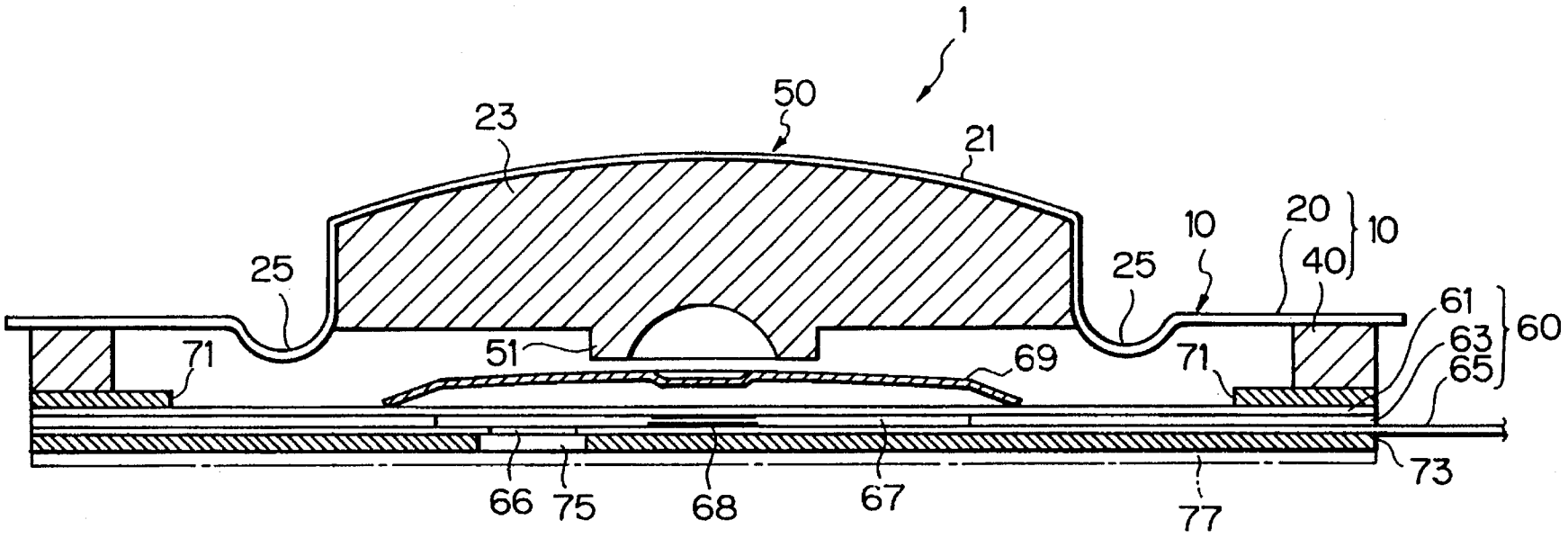
FIG. 1 is a side sectional view illustrating a push-button switch including a framed keytop sheet manufactured according to a first embodiment of the present invention.

FIG. 1 is a side sectional view illustrating a push-button switch including a keytop sheet formed according to a first embodiment of the present invention. As shown in FIG. 1, a push-button switch 1 includes a switch substrate 60 formed by superimposing an upper sheet 61, a spacer 63 and a lower sheet 65, and a keytop sheet 10 obtained by fixing a frame 40 to the outer periphery of the underside of a film sheet 20 provided with a keytop 50. A click spring 69 is attached to the switch substrate 60 over a switch contact 68, and the frame 40 of the keytop sheet 10 is affixed to the outer periphery of the switch substrate 60 via a sheet 71 having an adhesive on both sides thereof.

Figure 2A:
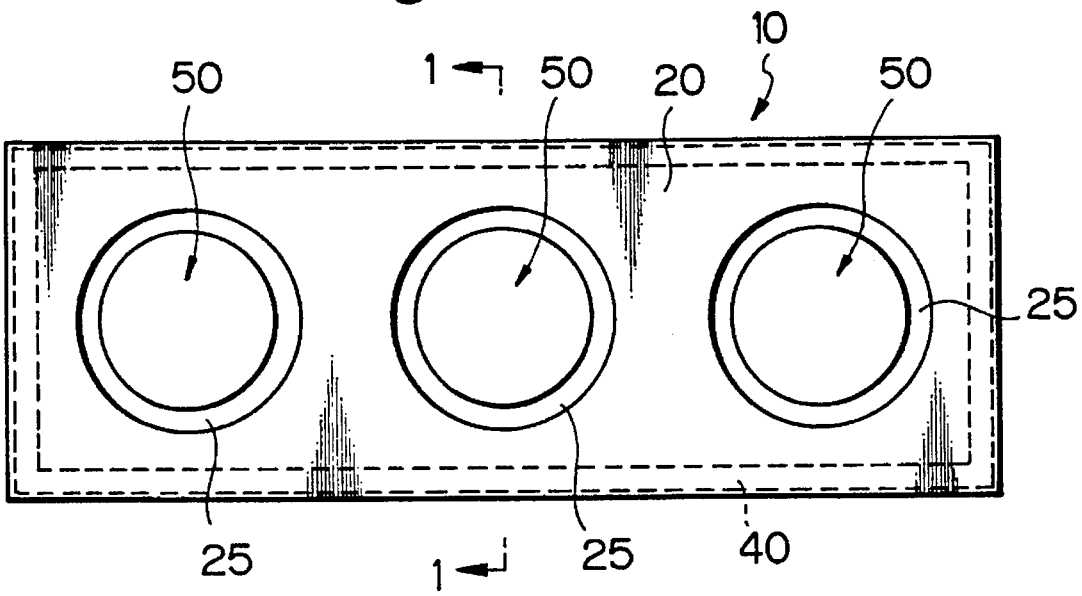
FIGS. 2(A) and 2(B) respectively are a plan view and a side view thereof.
Figure 2B:
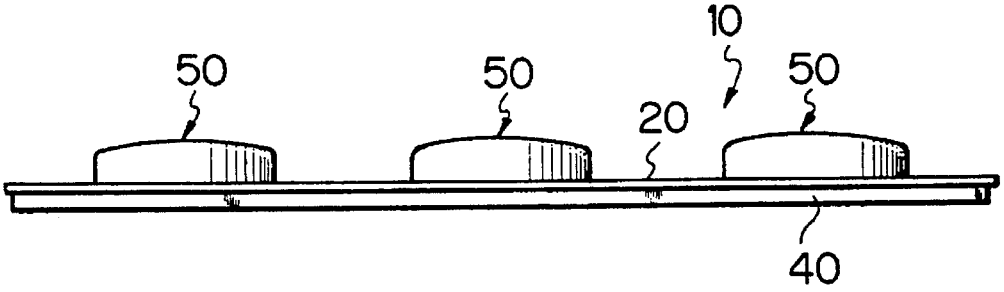

FIGS. 2(A) and 2(B) illustrate the keytop sheet 10, in which FIG. 2(A) is a plan view and FIG. 2(B) a side view. It should be noted that FIG. 1 is a sectional view taken along line 1—1 in FIG. 2(A). As shown in FIGS. 2(A) and 2(B), the keytop sheet 10 has three keytops 50 provided on the central portion of the film sheet 20, and the frame 40 is attached to the underside of the film sheet 20 along the outer periphery thereof. Further, the film sheet 20, at portions thereof surrounding portions on which the keytops 50 are molded, is provided with curved projections 25, each of which protrudes in a downward direction from the surface of the film sheet 20, so as to surround the respective keytops 50.

Figure 3A:
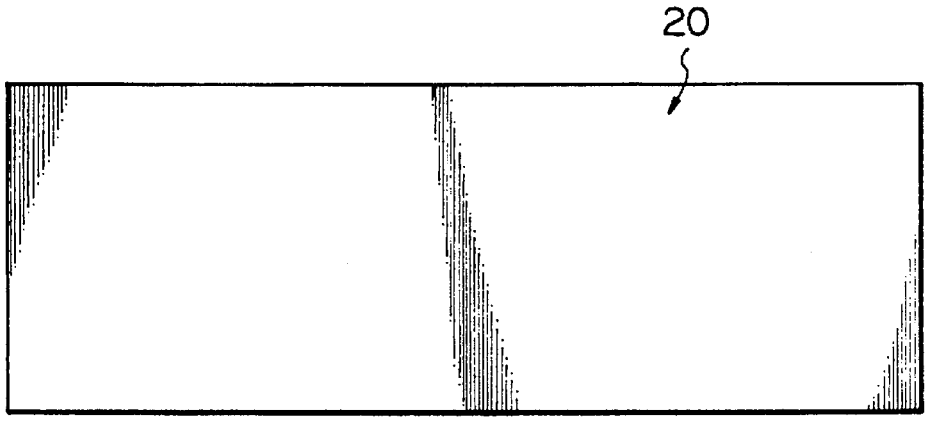
FIGS. 3(A) and 3(B) respectively are a plan view and a side view of a film sheet used in manufacture thereof.
Figure 3B:
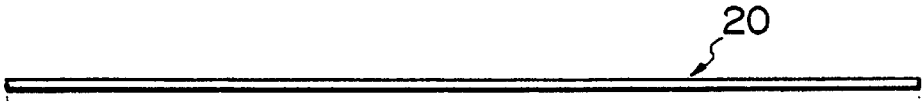
Figure 4:
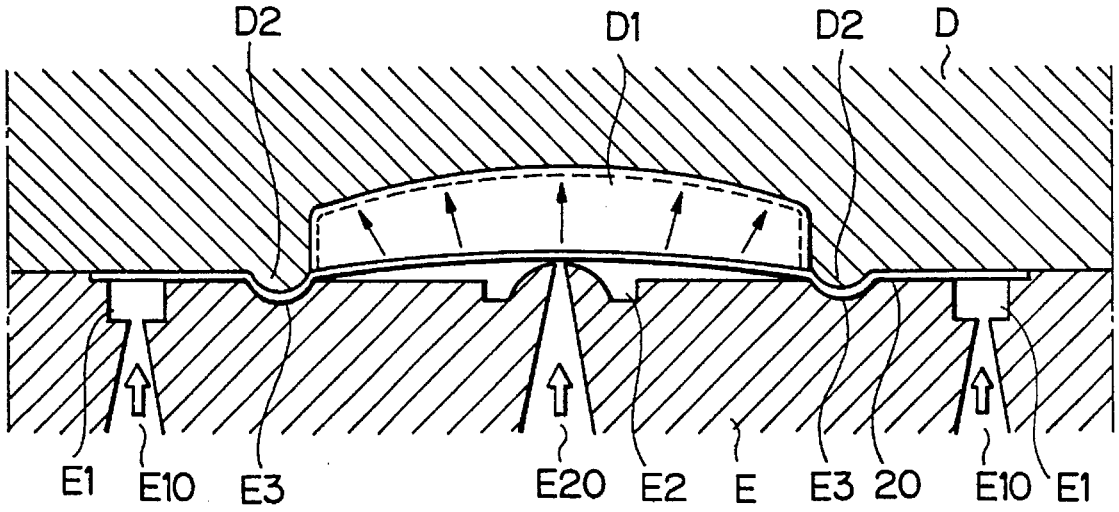
FIG. 4 is a diagrammatic section illustrating a method of forming the keytop sheet of FIG. 1 by resin molding.

In order to manufacture the keytop sheet 10, first the film sheet 20 is prepared. As shown in FIGS. 3(A) and 3(B), the film sheet 20 is manufactured by cutting a thermoplastic synthetic-resin film (e.g., polyethylene terephthalate, polyethylene naphthalate, etc.) into rectangular shape and printing a desired design (not shown) on the top side or underside of the sheet. Next, as illustrated in FIG. 4, the film sheet 20 is clamped between an upper mold D and a lower mold E. The upper mold D is provided with a cavity D1 for forming the keytop 50, and the lower mold E is provided with a cavity E1 for forming the frame 40 and a cavity E2 for forming the pushing portion 51 of the keytop 50. Further, the cavities E1, E2 of the lower mold E are provided with pin gate E10, E20, respectively. The portion of the upper mold D surrounding the cavity is provided with a ring-shaped projection D2 having a semicircular cross section. The lower mold E is provided with a ring-shaped cavity E3 at a position opposing the projection D2. The cavity E3 has a semicircular cross section and is formed to have such dimensions that a gap equivalent to the thickness of the film sheet 20 will be delimited between the cavity E3 and the projection D2 when the upper mold D and the lower mold E are closed.

When a molten resin under conditions of high temperature and pressure is forcibly introduced through the pin gates E10, E20, the frame 40 is formed on the outer peripheral portion on the underside of the film sheet 20, and the portion of the film sheet 20 situated at the cavity D1 is urged upwardly and is deformed against the inner surfaces of mold D defining the cavity D1, as indicated by the dashed lines in FIG. 4 thus forming a cavity within film sheet 20. At the same time, the cavity within film sheet 20 and the cavity E2 are filled with the molten resin. In other words, the film sheet 20 is formed to include a cavity or bulge 21 (see FIG. 1) having the shape of the inner surfaces defining the cavity D1, and the cavity 21 is filled with charged resin 23 that is allowed to harden to unify with the film sheet 20, thereby forming the keytop 50. Since the molten resin introduced at this time is at a high temperature and pressure and the film sheet 20 consists of thermoplastic resin, the forcibly introduced resin and film sheet 20 are directly and strongly fused together and the film sheet 20 will not peel off. The portion of the film sheet 20 clamped between the projection D2 and the cavity E3 shown in FIG. 4 is thermoplastically deformed into the clamped shape by the heat of the introduced molten resin and the heat from the upper and lower molds D, E themselves. As a result, the curved projection 25 is formed in the film sheet 20. As an alternative to forming the curved projection 25 in the film sheet 20 by the upper and lower molds D, E, the film sheet may be furnished with the curved projection 25 in advance by a forming process, after which the film sheet may be clamped between the upper and lower molds D, E. Separating the upper and lower molds D, E completes formation of the keytop sheet 10 shown in FIGS. 1, 2(A) and 2(B).

As shown in FIG. 1, the switch substrate 60 is an ordinary membrane switch and is produced by superimposing the upper and lower sheets 61, 65 with the spacer 63 sandwiched between them. The spacer 63 is provided with a hole 67 within which electrode patterns formed on respective ones of the upper and lower sheets 61, 65 are arranged in opposition to each other so as to construct the switch contact 68. The lower sheet 65 is provided with an air-venting hole 66. The click spring 69, which is made of metal or resin, is attached over the switch contact 68.

Sheets 71, 73, both sides of each of which are provided with an adhesive, are affixed to the upper and lower surfaces, respectively, of the switch substrate 60. The double-sided adhesive sheet 71 on the upper side is affixed so as to surround the entire outer periphery of the top side of the switch substrate 60, and the double-sided adhesive sheet 73 on the lower side covers the entire underside of the switch substrate 60 and is affixed in such a manner that an air-venting hole 75 therein is situated at a prescribed position relative to the switch substrate 60. It should be noted that a separator 77 is affixed to the underside of the lower double-sided adhesive sheet 73. Bonding the upper double-sided adhesive sheet 71 to the underside of the frame 40 of the keytop sheet 10 completes the push-button switch 1. When the push-button switch i is secured to another member, it will suffice to peel the separator 77 off and affix the underside of the double-sided adhesive sheet to the other member.

When the keytop 50 of the keytop sheet 10 is pressed, the pushing portion 51 presses the click spring 69, which snaps back to produce a clicking sensation, as well as the switch contact 68 to close the same. The curved projection 25 of film sheet 20 is deformed when the keytop 50 is pressed, as a result of which the pressing operation is facilitated. The reason for this is that when the keytop 50 is pressed, the stretching of the film by an amount equivalent to the stroke of the keytop 50 is compensated for (absorbed) by the shape deformation of the curved projection 25.

Further, since the film sheet 20 of the keytop sheet 10 is not provided with any holes, water cannot penetrate the push-button switch 1 to the underside of the film sheet 20 even if the switch is exposed to water from above.

In the embodiment described above, the keytop 50 can be brightly illuminated from its lower side if the resin 23 consists of a transparent material and a light-emitting element is disposed at a prescribed position below the keytop 50.

Further, in the embodiment described above, a membrane switch comprising a flexible substrate is used as the switch substrate 60. However, it is permissible to use switch substrates of other types, such as a rigid substrate.

Although the frame 40 is provided on the periphery of the underside of film sheet 20 so as to surround the keytop 50, it is not always necessary for the keytop sheet in this invention to have the frame 40. More specifically, a keytop sheet devoid of a frame may be arranged directly on a switch substrate, or a keytop sheet devoid of a frame may be retained by another member and this member may be arranged on the switch substrate.

Further, in the first embodiment described above, there are instances in which the adhesion between the film sheet 20 and keytop 50 is weak, depending upon the quality and thickness of the film sheet 20 or the quality and melting temperature of the molding resin used to form the keytop 50 and the frame 40. In such case the union between the film sheet and keytop can be strengthened if an adhesive layer is interposed therebetween.

Figure 5:
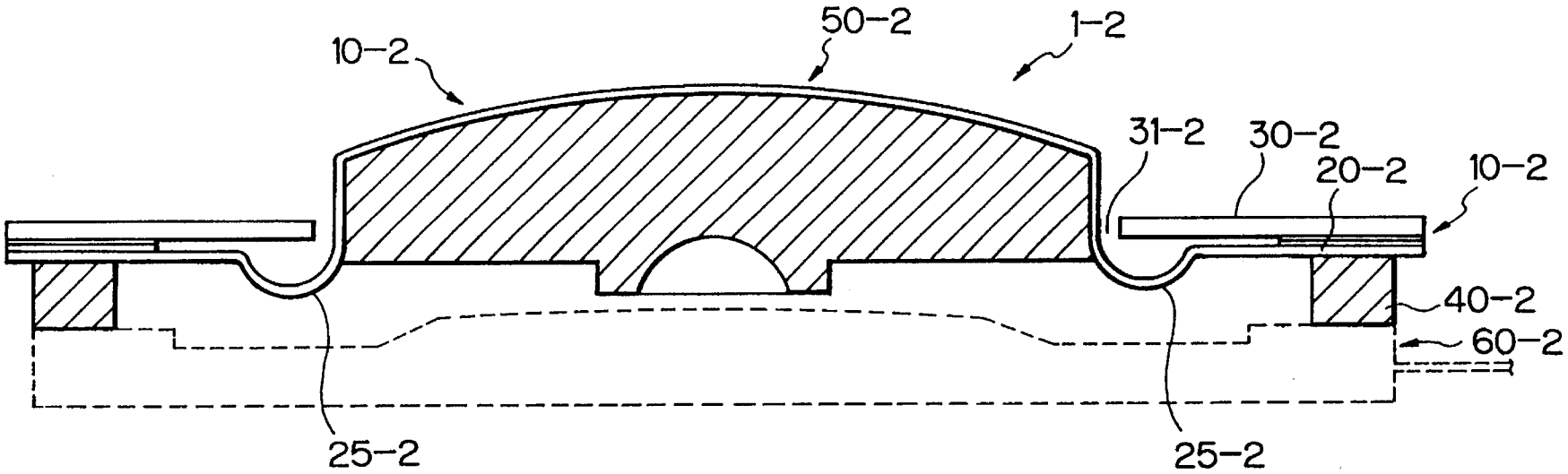
FIG. 5 is a schematic side sectional view illustrating a push-button switch including a keytop sheet formed according to a second embodiment of the present invention.

FIG. 5 is a schematic side sectional view illustrating a push-button switch 1-2 including a keytop sheet 10-2 formed according to a second embodiment of the present invention. Since a switch substrate 60-2 is identical with the switch substrate 60 of the first embodiment, the outline of the switch substrate 60-2 is indicated by dashed lines in FIG. 5.

This embodiment differs from the first embodiment in that a nameplate 30-2 is affixed to the upper side of a film sheet 20-2. The nameplate 30-2 is provided with a circular hole 31-2 through which keytop 50-2 passes. More specifically, the nameplate 30-2 is affixed to the film sheet 20-2 in such a manner that the keytop 50-2 passes through the hole 31-2. In this arrangement, curved projection 25-2 provided on the film sheet 20-2 will no longer be visible to the eye. In addition, printing can be provided on the top side or underside of the nameplate 30-2 in a variety of ways.

Figure 6:
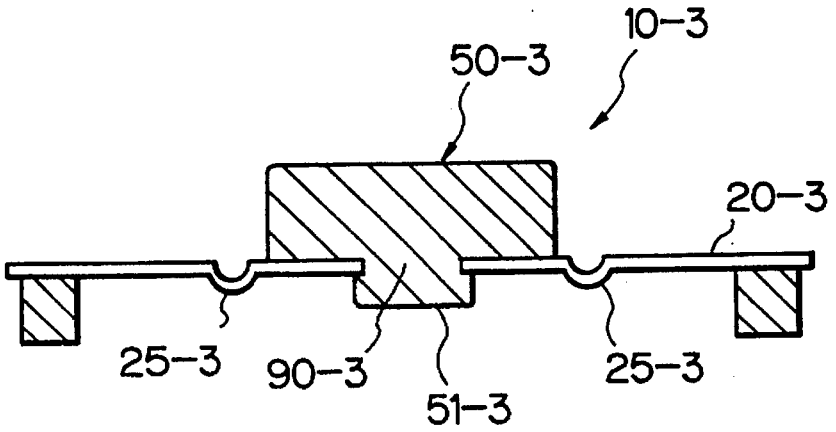
FIGS. 6(A) and 6(B) illustrate a keytop sheet formed according to a third embodiment of the present invention, FIG. 6(A) being a side sectional view taken along line 6(A)—6(A) of FIG. 6(B), and FIG. 6(B) being a plan view of a principal portion.
Figure 6:
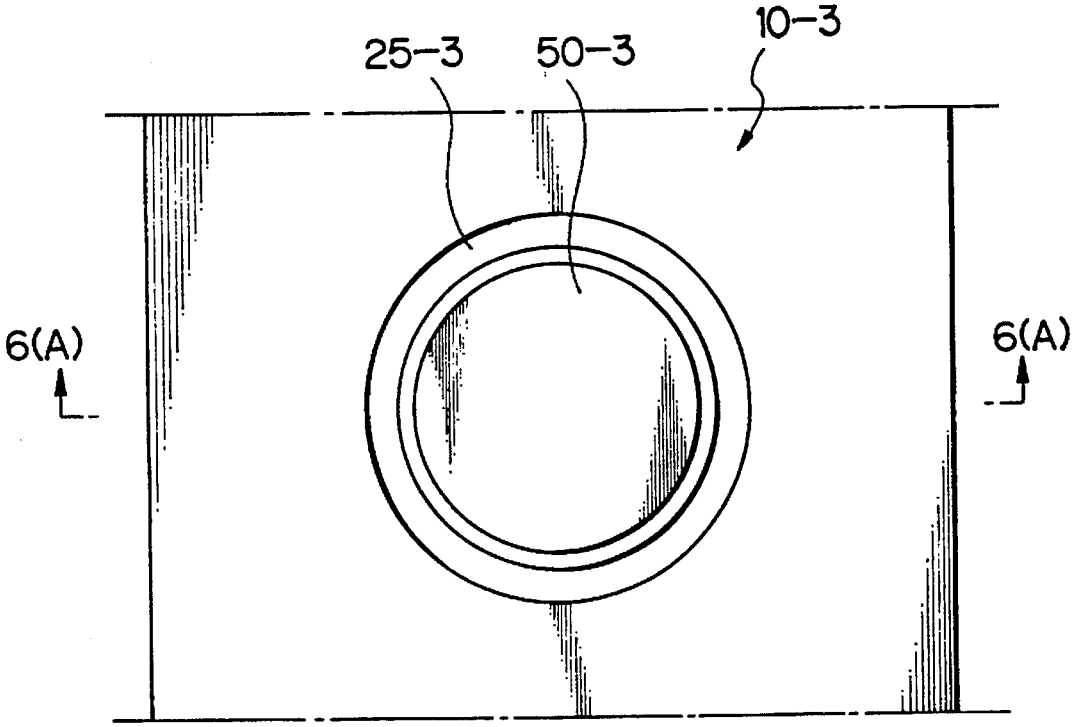

FIGS. 6(A) and 6(B) illustrate a keytop sheet 10-3 formed according to a third embodiment of the present invention, FIG. 6(A) being a side sectional view taken along line 6(A)—6(A) of FIG. 6(B) and FIG. 6(B) being a plan view of a principal portion. The keytop sheet 10-3 shown in FIGS. 6(A) and 6(B) includes a film sheet 20-3 provided with a hole 90-3, and a keytop 50-3 molded by charging molten resin above and below the film sheet 20-3 via the hole 90-3. In this embodiment, a pushing portion 51-3 of the keytop 50-3 is situated on the underside of the keytop 50-3 at the central portion thereof, just as in the first and second embodiments. Further, a curved projection 25-3 is provided surrounding the keytop 50-3.

Figure 7:
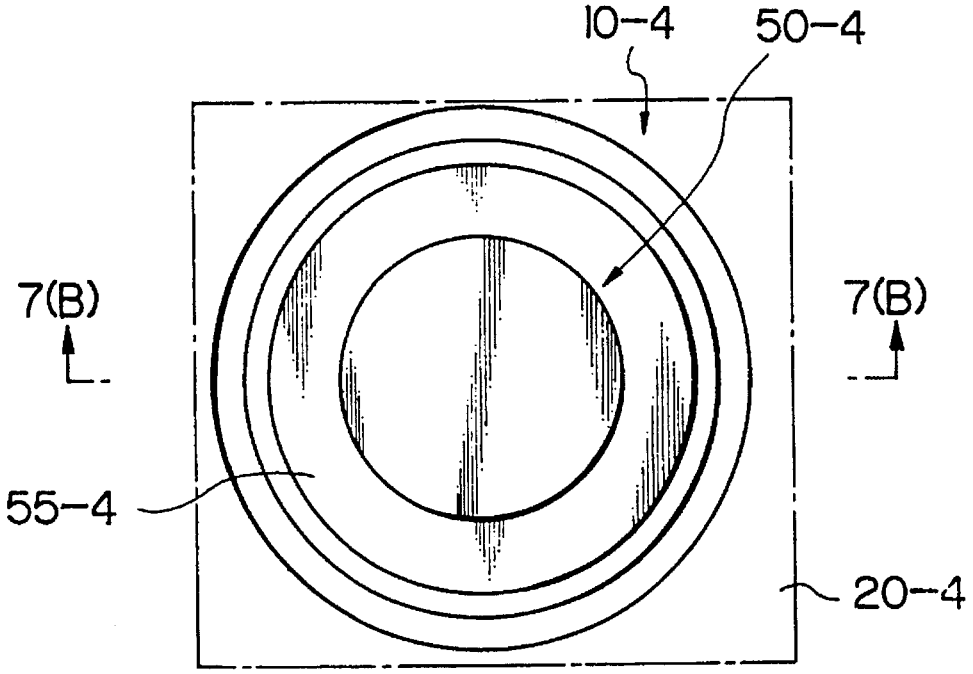
FIGS. 7(A), 7(B) and 7(C) illustrate a portion of a keytop sheet formed according to a fourth embodiment of the present invention, FIG. 7(A) being a plan view, FIG. 7(B) being a side sectional view taken along line 7(B)—7(B) of FIG. 7(A) and FIG. 7(C) being a bottom view.
FIG. 7(D) is a plan view of a film sheet used in formation of the keytop sheet of this embodiment.
Figure 7:
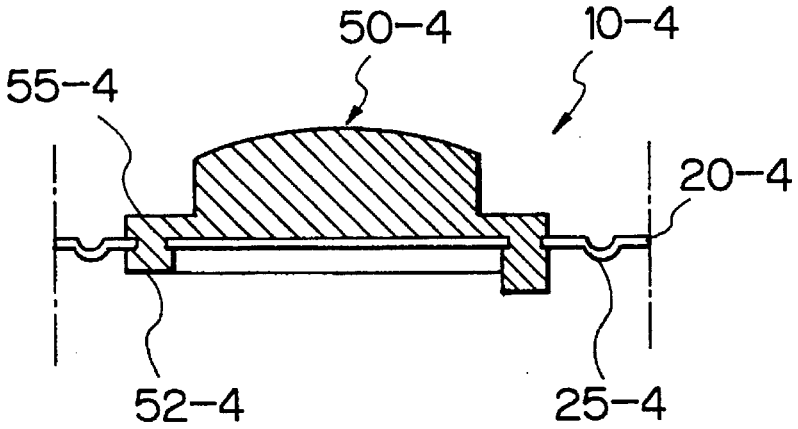
Figure 7:
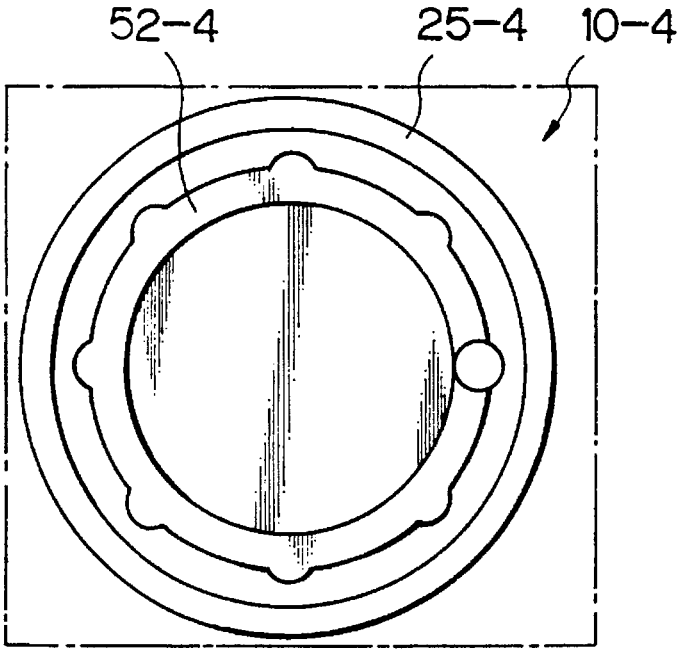
Figure 7:
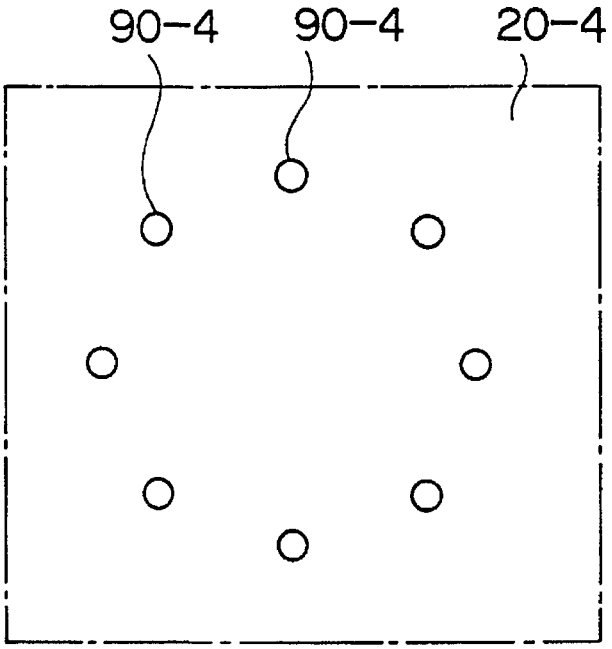

FIGS. 7(A), 7(B) and 7(C) illustrate a portion of a keytop sheet 10-4 formed according to a fourth embodiment of the present invention, FIG. 7(A) being a plan view, FIG. 7(B) being a side sectional view taken along line 7(B)—7 (B) of FIG. 7(A) and FIG. 7(C) being a bottom view. FIG. 7 (D) is a plan view of a film sheet 20-4 used in formation of the keytop sheet 10-4. Film sheet 20-4 is provided with eight holes 90-4 in a ring-shaped configuration, as shown in FIG. 7(D), and a keytop 50-4 is molded by charging molten resin above and below the film sheet 20-4 via the holes 90-4. According to this embodiment, the film sheet 20-4 is clamped and secured by a film fixing portion 55-4 molded on the outer periphery of the top side of keytop 50-4 and a ring-shaped film retaining portion 52-4 molded on the underside of the film sheet 20-4. The periphery of the keytop 50-4 is surrounded by a curved projection 25-4 of film sheet 20-4.

Figure 8:
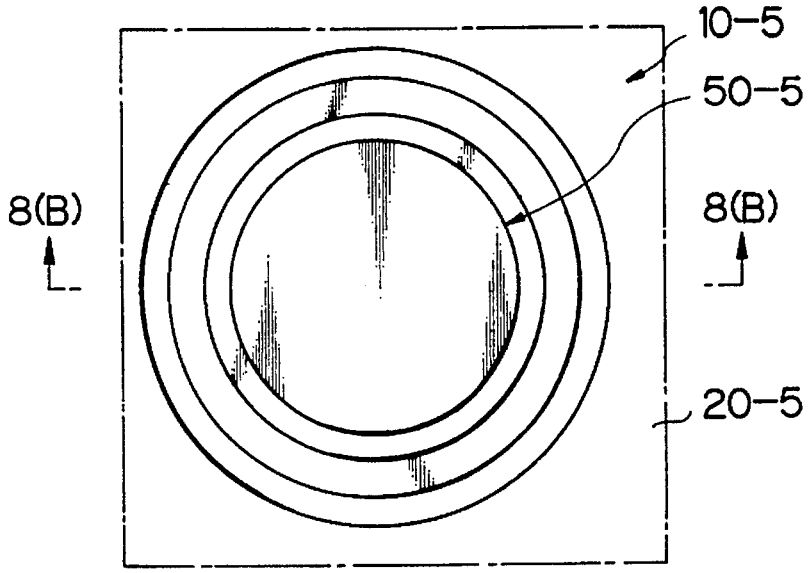
FIGS. 8(B), 8(B) and 8(C) illustrate a portion of a keytop sheet formed according to a fifth embodiment of the present invention, FIG. 8(A) being a plan view, FIG. 8(B) being a side sectional view taken along line 8(B)—8(B) of FIG. 8(A) and FIG. 8(C) being a bottom view.
Figure 8:
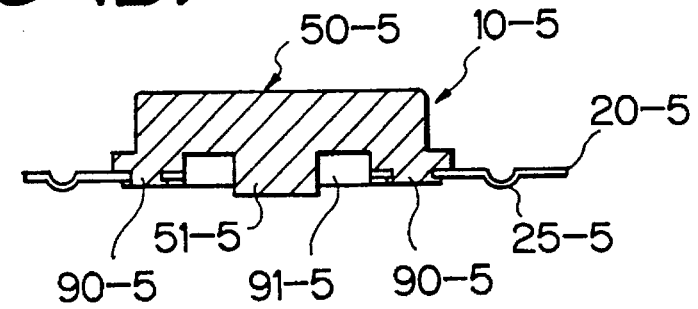
Figure 8:
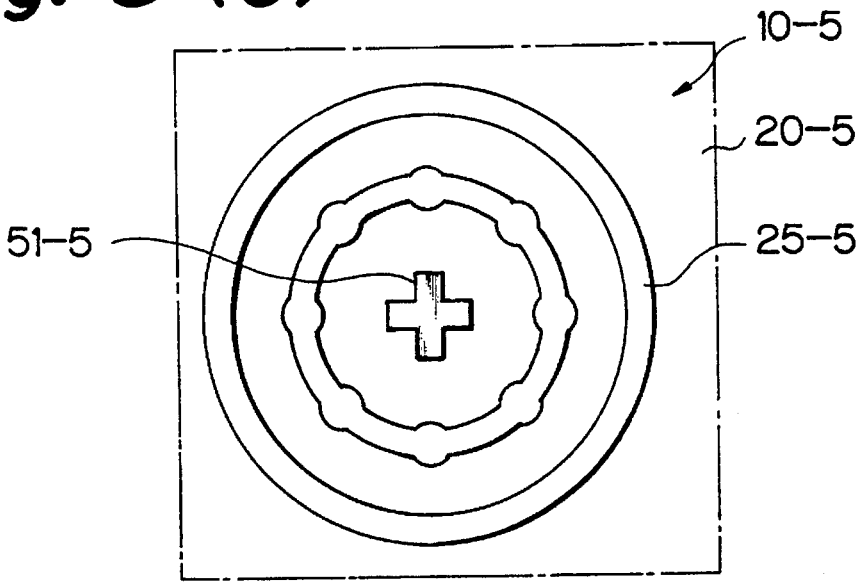

FIGS. 8(A), 8(B) and 8(C) illustrate a portion of a keytop sheet 10-5 formed according to a fifth embodiment of the present invention, FIG. 8(A) being a plan view, FIG. 8(B) being a side sectional view taken along line 8(B)—8(B) of FIG. 8(A) and FIG. 8(C) being a bottom view. A film sheet 20-5 is provided with holes 90-5 in a ring-shaped configuration in a manner similar to that shown in FIG. 7(D), a large hole 91-5 is provided at the center of the ring, and a keytop 50-5 is molded by charging molten resin above and below the film sheet 20-5 via the holes 90-5, 91-5. The periphery of the keytop 50-5 is surrounded by a curved projection 25-5 of film sheet 20-5.

Figure 9:
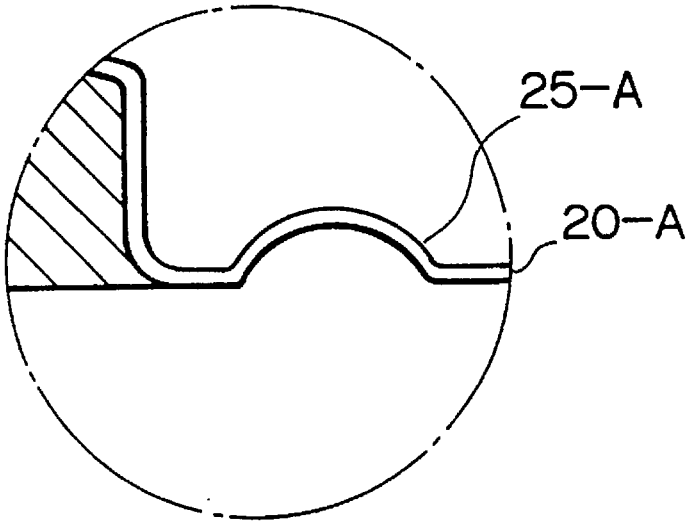
FIGS. 9(A) and 9(B) are partial sections illustrating other configurations of curved projections formed according to the present invention.
Figure 9:
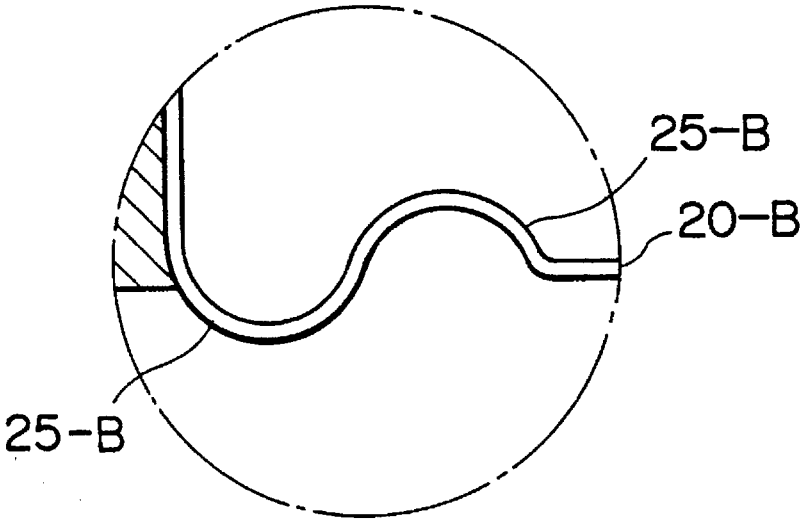

In the first through fifth embodiments described above, the curved projection protrudes downwardly from the surface of the film sheet. However, as shown in FIG. 9(A), a curved projection 25-A may be formed so as to protrude upwardly from the surface of a film sheet 20-A, or, as shown in FIG. 9(B), curved projections 25-B may be formed so as to protrude upwardly and downwardly in the manner of a wave relative to the surface of a film sheet 20-B. In the latter case, the greater the length of the curved projections 25-B in comparison with the other embodiments, the easier it is to press the keytop.

Figure 10:
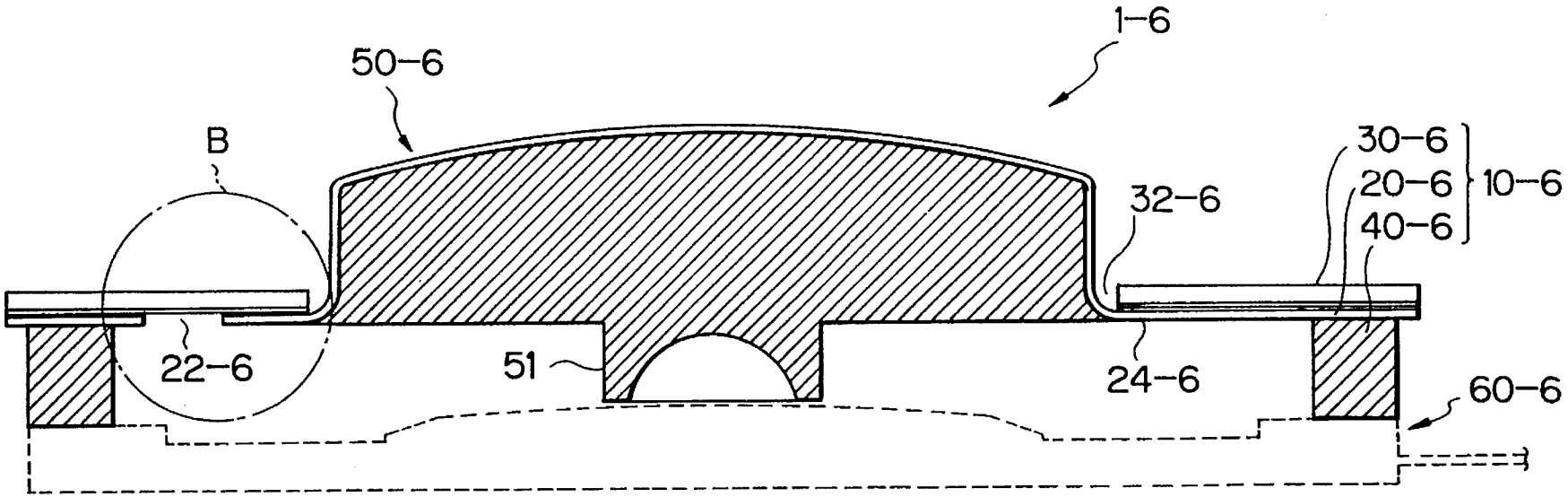
FIG. 10 is a side sectional view illustrating a push-button switch including a keytop sheet formed according to a sixth embodiment of the present invention.
Figure 11:
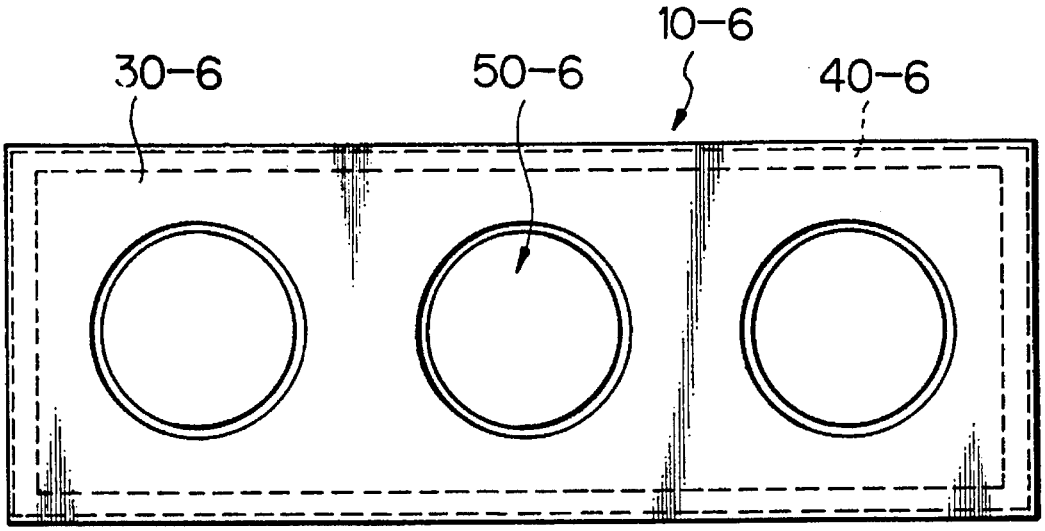
FIGS. 11(A) and 11(B) respectively are a plan view and a side view thereof.
Figure 11:
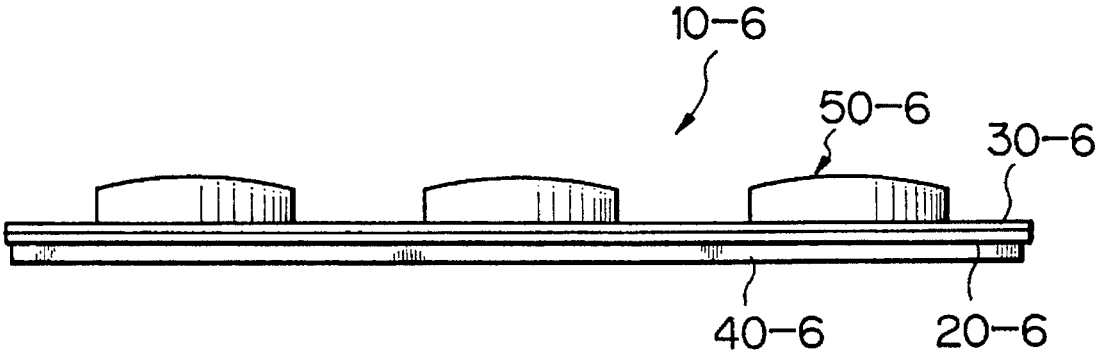
Figure 12:
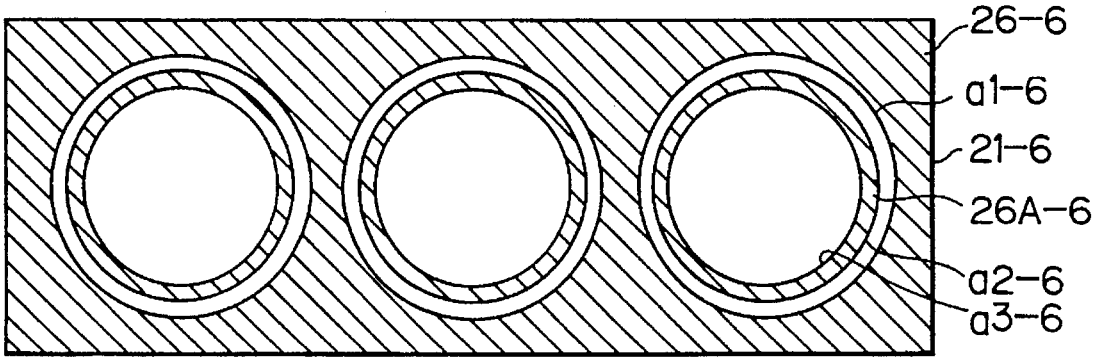
FIGS. 12(A), 12(B), 12(C) are plan views illustrating a procedure for manufacturing a film sheet thereof.
Figure 12:
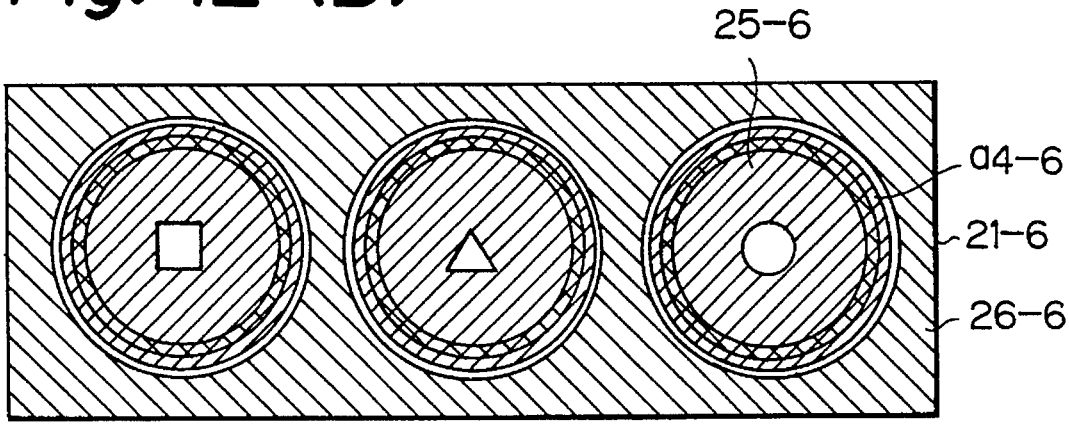
Figure 12:
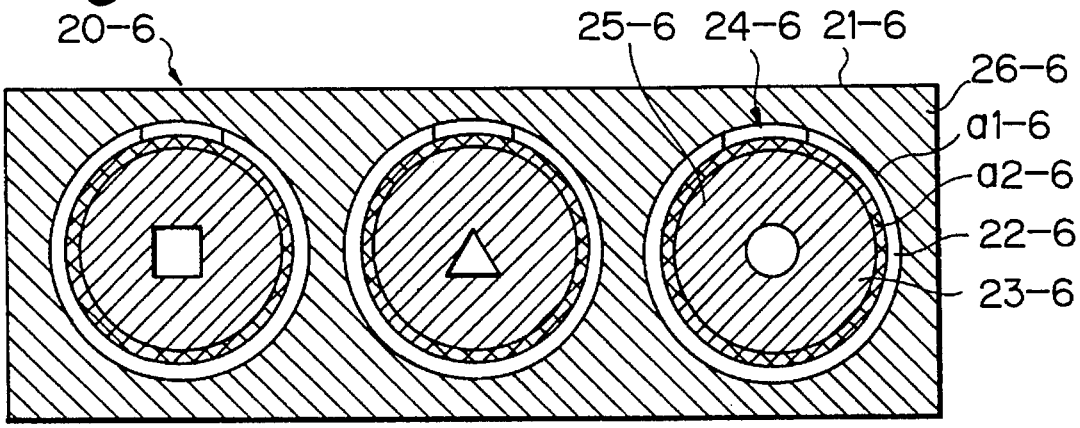

FIG. 10 is a side sectional view illustrating a push-button switch 1-6 including a keytop sheet 10-6 formed according to a sixth embodiment of the present invention. As shown in FIG. 10, the push-button switch 1-6 includes keytop sheet 10-6 including nameplate 30-6 and a frame 40-6 secured above and below a film sheet 20-6 provided with a keytop 50-6, and a switch substrate 60-6 (only the outline of which is shown) that is the same as the switch substrate 60 depicted in FIG. 1. FIGS. 11(A) and 11(B) illustrate the keytop sheet 10-6 of FIG. 10, FIG. 11(A) being a plan view and FIG. 11(B) being a side view. FIGS. 12(A), 12(B) and 12(C) are plan views illustrating a procedure for manufacturing the film sheet 20-6, and FIGS. 13(A), 13(B) and 13(C) are bottom views illustrating a procedure for manufacturing the nameplate 30-6.

In order to manufacture the film sheet 20-6, first a thermoplastic synthetic resin 21-6 (e.g., polyethylene terephthalate, polyethylene naphthalate, etc.) is prepared, as shown in FIG. 12(A), and a bonding agent 26-6 such as epoxy resin or urethane resin is printed on the top side of the film sheet 21-6 to a thickness of 25~30 μm. The bonding agent 26-6 is applied to the entirety of the film sheet 21-6 with the exception of the interior of a circle a1-6, and to a ring-shaped portion 26A-6 located within the circle a1-6. The ring-shaped portion 26A-6 is a portion between two circles a2-6 and a3-6. Next, as shown in FIG. 12(B), decorative printing 25-6 comprising a desired design or the like is applied to a prescribed position of the film sheet 21-6. The decorative printing 25-6 is applied inwardly of a circle a4-6 between the circle a1-6 and the circle a2-6 illustrated in FIG. 12(A). It should be noted that the thickness of the decorative printing 25-6 is on the order of 5~7 μm. Next, as shown in FIG. 12(C), a portion between the circles a1-6 and a2-6 of the film sheet 21-6 is cut away to provide a C-shaped cut-out 22-6. As a result, a structure is obtained in which a circular keytop portion 23-6 is connected to the film 21-6 solely by a hinge portion 24-6 of small width.

Figure 13:
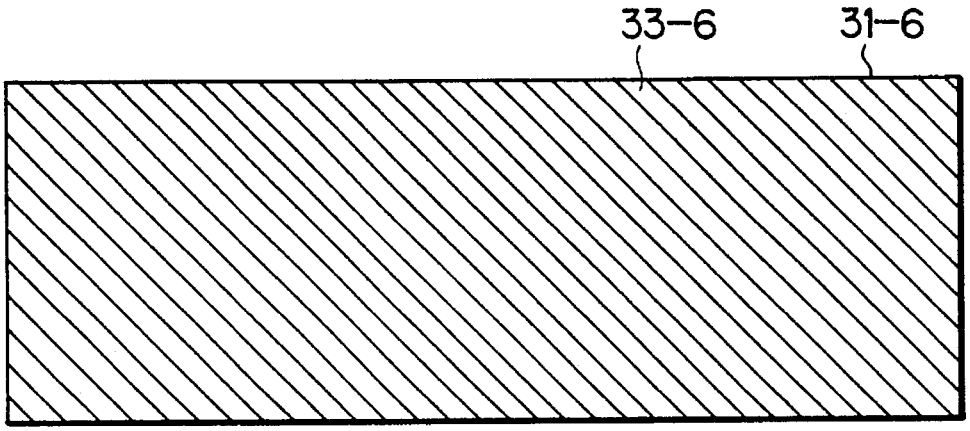
FIGS. 13(A), 13(B), 13(C) are plan views illustrating a procedure for manufacturing a nameplate thereof.
Figure 13:
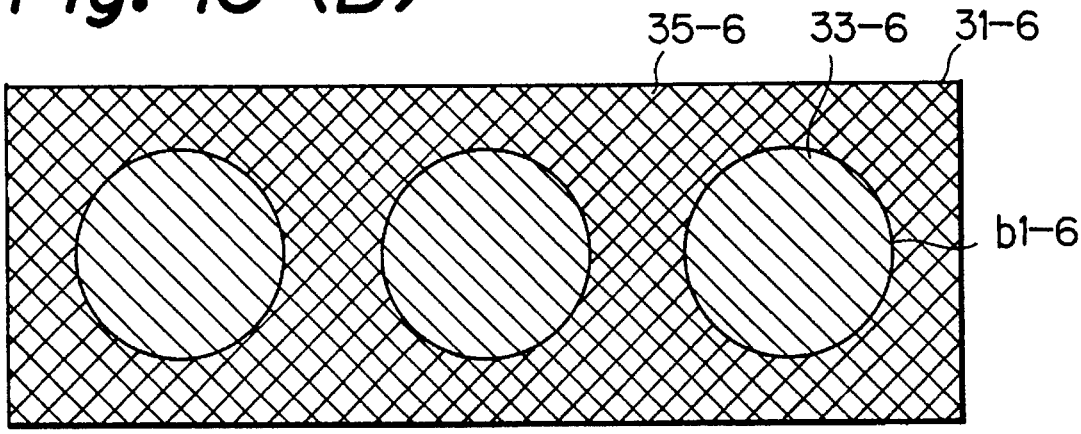
Figure 13:
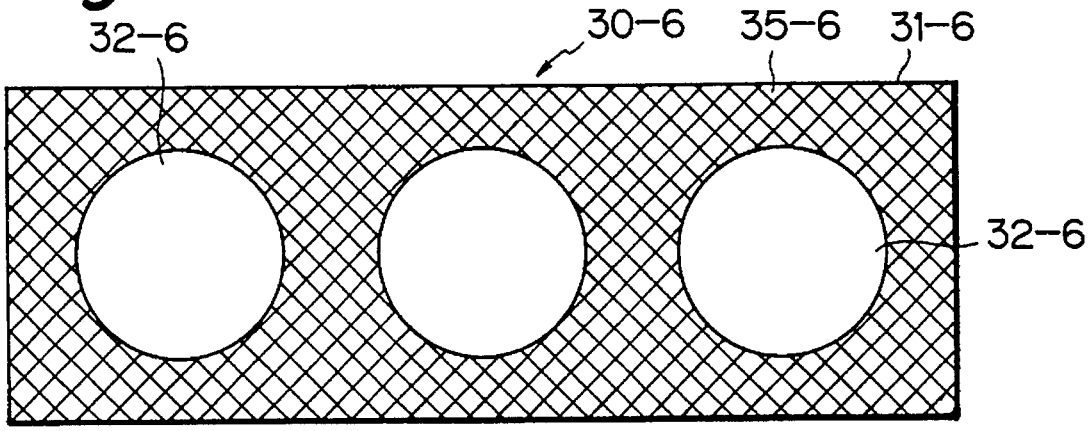

In order to manufacture the nameplate 30-6, first a synthetic resin film 31-6 (e.g., polyethylene terephthalate or the like, a thermoplastic resin need not necessarily be used) is prepared and printing 33-6 such as a desired design is applied over the entire underside of the film 31-6, as illustrated in FIG. 13(A). Next, as shown in FIG. 13(B), a bonding agent 35-6 such as epoxy resin or urethane resin is printed on the printing 33-6. It should be noted that the bonding agent 35-6 is not printed on the inner side of a circle b1-6. The diameter of the circle b1-6 is made the same as that of the circle a3-6 shown in FIG. 12(A). The portion of the film 31-6 on which the bonding agent 35-6 has not been printed is cut away, as shown in FIG. 13(C), thereby providing a circular hole 32-6. The diameter of the hole 32-6 is the same as the diameter of the circle b1-6.

The nameplate 30-6 shown in FIG. 13(C) is placed upon the film sheet 20-6 of FIG. 12(C) in such a manner that the two layers of bonding agents 26-6, 35-6 contact each other. The nameplate 30-6 and film sheet 20-6 are bonded strongly together by thermocompression bonding.

Next, the keytop 50-6 and frame 40-6 are provided simultaneously, by resin molding, on the unitary body comprising the film sheet 20-6 and nameplate 30-6. This method will now be described with reference to FIG. 14. The film sheet 20-6 and nameplate 30-6 united in the manner set forth above are clamped between an upper mold D-6 and a lower mold E-6. The upper mold D-6 is provided with a cavity D1-6 for forming the keytop 50-6, and the lower mold E-6 is provided with a cavity El-6 for forming the frame 40-6 and a cavity E2-6 for forming a pushing portion 51-6 of the keytop 50-6. The cavities E1-6, E2-6 of the lower mold E-6 are provided with pin gates E10-6, E20-6, respectively.

Figure 14:
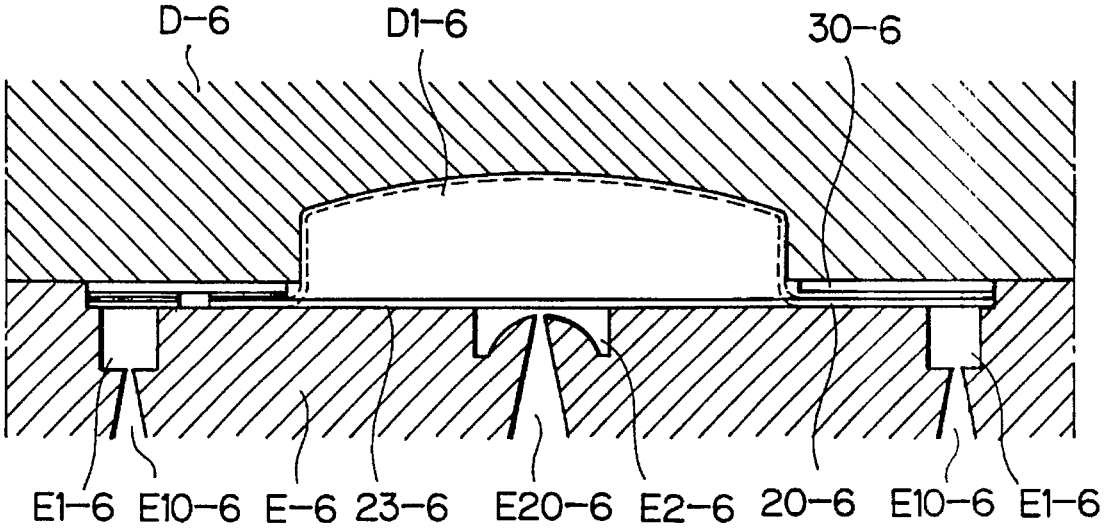
FIG. 14 is a diagrammatic section illustrating a method of forming the keytop sheet of FIG. 10 by resin molding.

When a high-temperature, high-pressure molten resin is forcibly introduced through the pin gates E10-6, E20-6, frame 40-6 is formed on the outer periphery of the underside of the film sheet 20-6, and a keytop portion 23-6 of the film sheet 20-6 is urged upwardly and deformed so as to adhere to the inner surfaces of the mold D-6 defining cavity D1-6, as indicated by the dashed lines in FIG. 14, thus forming a cavity within portion 23-6. At the same time, the cavity within portion 23-6 and the cavity E2-6 are filled with the molten resin. Since the thermoplastic molten resin introduced at this time is at a high temperature and pressure and the film sheet 20-6 consists of thermoplastic resin, the forcibly introduced resin and film sheet 20-6 are directly and strongly fused together so that the film sheet 20-6 will not peel off. It should be noted that an adhesive layer may be interposed between the resin and the film sheet, as described earlier in connection with the first embodiment. In other words, the portion of the film sheet 20-6 having the keytop portion 23-6 is caused to protrude and deform upwardly, thereby forming a bulge having the shape of the inner surface of the cavity D1-6, and the synthetic resin is caused to fill the interior of the bulge and is allowed to harden so as to integrate the resin and the film sheet and form the keytop 50-6. Separating the upper and lower molds D-6, E-6 completes formation of the keytop sheet 10-6 shown in FIGS. 10–11(B).

As shown in FIGS. 10 and 11(A), the cut-out 22-6 [see FIG. 12(C)] provided in the film sheet 20-6 is concealed by being covered by the nameplate 30-6 and therefore cannot be seen from upper side. This makes it possible to maintain an attractive appearance of the keytop sheet 10-6. Further, though the hinge portion 24-6 [see FIG. 12(C)] of the film sheet 20-6 develops a wrinkle when the keytop 50-6 is pressed, the hinge portion 24-6 also is covered and concealed by the nameplate 30-6 so that the attractive appearance of the keytop sheet is maintained in this sense as well.

Figure 15:
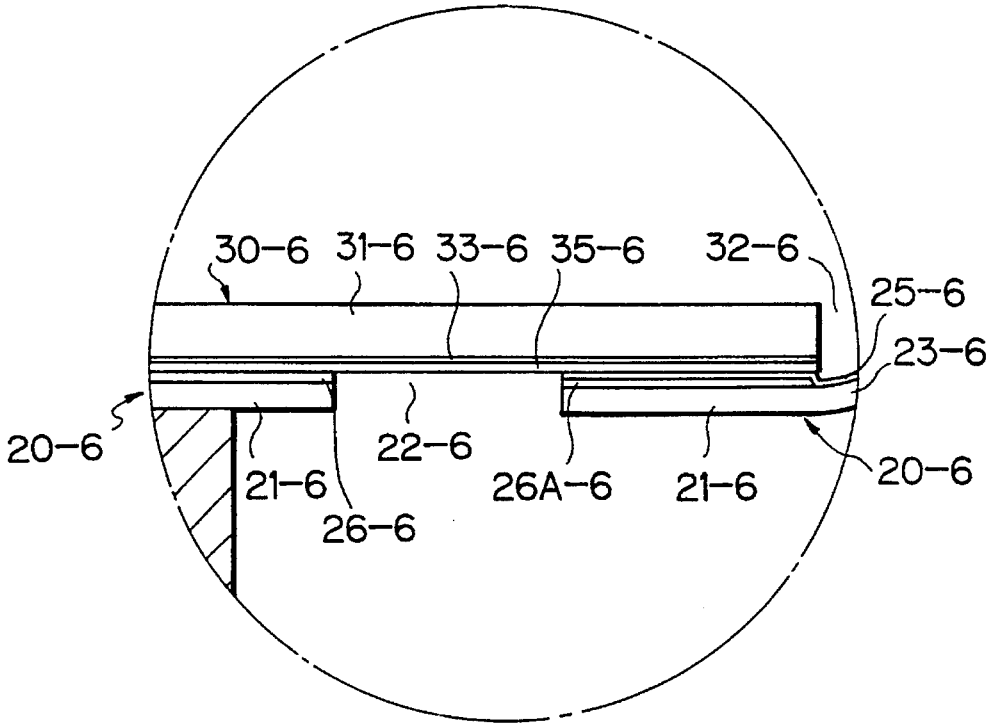
FIG. 15 is an enlarged view of an encircled portion B in FIG. 10.

FIG. 15 is an enlarged view of portion B in FIG. 10. As illustrated in FIG. 15, since the layer of bonding agent 26-6 of the film sheet 20-6 and the layer of bonding agent 35-6 of the nameplate 30-6 are in direct contact with each other, the two are bonded together by heat. However, since the decorative printing 25-6 has been applied to the ring-shaped portion 26A-6, the two are not bonded together at this portion even though heat is applied. In other words, the two members are merely in contact with each other at this portion. The ring-shaped portion 26A-6 is provided for the following reason. If the ring-shaped portion 26A-6 of a prescribed thickness were not provided, a gap would be produced between the bonding agent 35-6 of the nameplate 30-6 and the decorative printing 25-6 of the film sheet 20-6 in this region. When clamped between the molds D-6, E-6 shown in FIG. 14, the film sheet 20-6 of the ring-shaped portion 26A-6 and the nameplate 30-6 could not be clamped together strongly and fixedly secured. If this portion cannot be fixedly secured, the molten resin will flow out from the gap to the side of the cut-out 22-6 of the film sheet 20-6 when the molten resin is charged. Such a molding operation is unsatisfactory.

A particular characterizing feature of this embodiment is that the thickness of the portion where the film sheet 20-6 of the ring-shaped portion 26A-6 and the nameplate 30-6 overlap is equal to the sum of the thickness of the film 21-6, the thickness of the ring-shaped portion 26A-6, the thickness of the decorative printing 25-6, the thickness of the bonding agent 35-6, the thickness of the decorative printing 33-6 and the thickness of the film 31-6. By contrast, the thickness of the portion where the film sheet 20-6 and nameplate 30-6 overlap is equal to the sum of the thickness of the film 21-6, the thickness of the bonding agent 26-6, the thickness of the bonding agent 35-6, the thickness of the decorative printing 33-6 and the thickness of the film 31-6. In other words, the thickness of the portion where the film sheet 20-6 of the ring-shaped portion 26A-6 and the nameplate 30-6 overlap is greater than that of other portions by the thickness of the decorative printing 25-6. As a consequence, the clamping of this portion by the molds D-6, E-6 is strengthened and made more certain.

In the above-described embodiment, the film sheet 20-6 and the nameplate 30-6 are bonded together by a thermocompression bonding step. However, this step is not always necessary. The reason is that if the above-mentioned members are clamped between the upper and lower molds D-6, E-6 shown in FIG. 14 in a state in which the film sheet 20-6 and nameplate 30-6 are merely superimposed (i.e., without being bonded together by thermocompression) and the molten resin is forcibly introduced, the two layers of bonding agents 25-6, 35-6 are melted and bonded together by the pressure and heat of the molten resin and the temperature of the high-temperature molds D-6, E-6.

If the keytop sheet 10-6 is attached to the switch substrate 60-6 and the keytop 50-6 of the keytop sheet 10-6 is pressed, the pushing portion 51 presses the click spring of the switch substrate 60-6 and the switch contact, thereby closing the switch contact. When the keytop 50-6 is pressed, the hinge portion 24-6 flexes since the film sheet 20-6 is provided with the cut-out 22-6 and the keytop 50-6 is merely connected to the film sheet 20-6 by the hinge portion 24-6. As a result, the keytop 50-6 is very easy to depress.

In the embodiment described above, the keytop 50-6 can be brightly illuminated from its lower side if the charged resin consists of a transparent material and a light-emitting element is disposed on the switch substrate 60-6.

In the sixth embodiment described above, the hinge portion 24-6 is provided at only one location. However, the invention is not limited to such an arrangement, and hinge portions may be provided at a plurality of locations.

Figure 16:
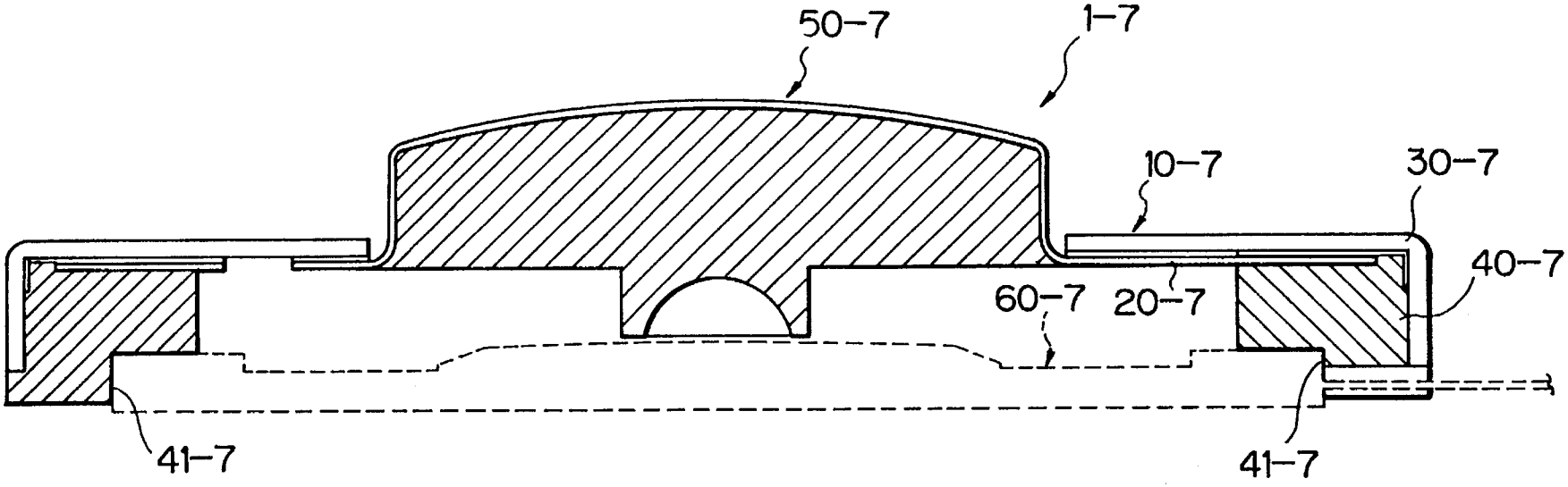
FIG. 16 is a side sectional view illustrating a push-button switch including a keytop sheet formed according to a seventh embodiment of the present invention.

FIG. 16 is a side sectional view illustrating a push-button switch 1-7 including a keytop sheet 10-7 formed according to a seventh embodiment of the present invention. Though this embodiment has approximately the same structure as that of the sixth embodiment, it differs from the sixth embodiment in that a nameplate 30-7 is formed to have an outer dimension greater than that of a film sheet 20-7 by a predetermined amount, and the outer peripheral portion of the nameplate 30-7 that extends beyond the film sheet 20-7 is bent transversely and secured to a side face of a frame 40-7.

Figure 17:
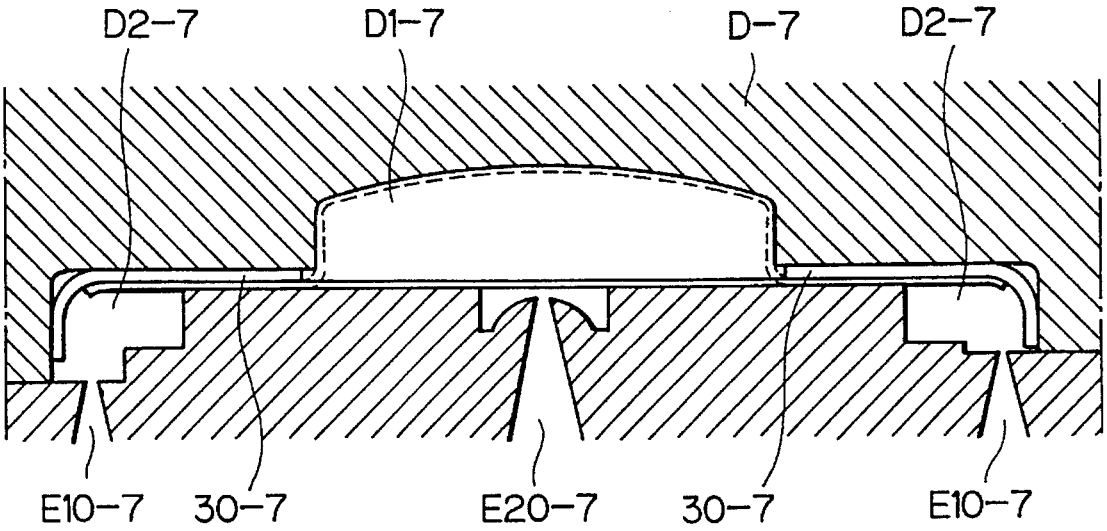
FIG. 17 is a diagrammatic section illustrating a method of forming the keytop sheet of FIG. 16 by resin molding.

FIG. 17 illustrates a method of forming the keytop sheet 10-7 of FIG. 16 by resin molding. As shown in FIG. 17, an upper mold D-7 has an outer peripheral portion surrounding a cavity D1-7, and such outer peripheral portion is extended downwardly and has a second cavity D2-7. When molten resin is forcibly introduced from pin gates E10-7, E20-7, the outer peripheral portion of the nameplate 30-7 is urged against an outer peripheral side face of mold D-7 that defines the second cavity D2-7.

The reason for adopting this configuration is as follows. In the case of the push-button switch 1-6 according to the sixth embodiment shown in FIG. 10, an outer peripheral face f of the keytop sheet 10-6 is plate-shaped [see FIG. 18(A)]. As a result, when it is attempted to conceal the keytop sheet 10-6 by a case 80-6 for the sake of design and so that the film sheet 20-6 will not peel off the nameplate 30-6, it is necessary to make the surface of the top h of the push-button switch 1-6 lower than the top g of a side wall 81-6 of the case 80-6 when the push-button switch 1-6 is fitted into the case 80-6. Consequently, dust tends to accumulate at a stepped portion 83-6 produced by the two top surfaces g, h. Owing to possible errors in assembly of the push-button switch 1-6, some dimensional error can develop in the thickness of the push-button switch 16. Owing to this error in the thickness direction, there is the danger that the surface h may exceed that of the surface g. This means that assembly errors in the thickness direction of the push-button switch 1-6 must be reduced. Accordingly, strict measurement must be taken to deal with assembly errors in the thickness direction.

Figure 18:
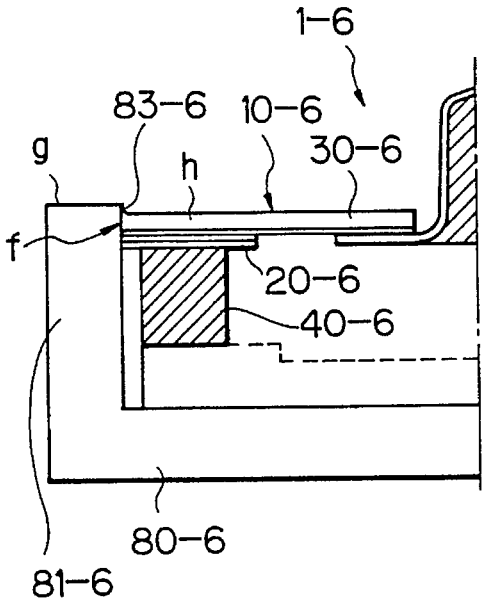
FIG. 18(A) is a schematic view of a principal portion of the push-button switch of FIG. 10 accommodated in a case.
FIG. 18(B) is a schematic view of a principal portion of the push-button switch of FIG. 16 accommodated in a case.
Figure 18:
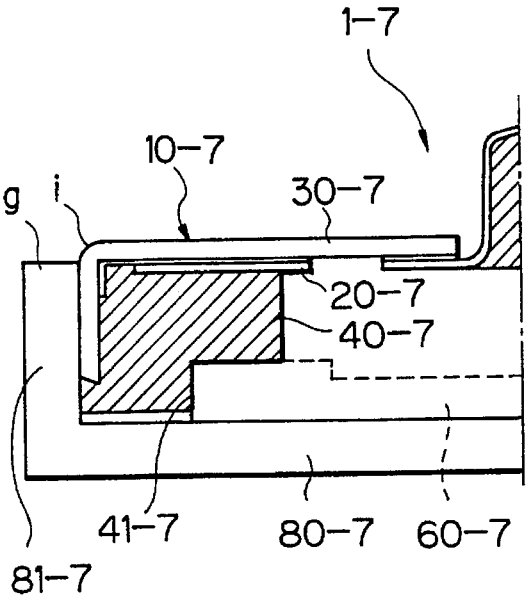

By contrast, in the case of a push-button switch 1-7 using the keytop sheet 10-7 according to the seventh embodiment, an upper edge i of the outer periphery of the keytop sheet 10-7 is covered by nameplate 30-7, as shown in FIG. 18(B). As a result, even if the upper edge i on the outer periphery is made to project somewhat from the top side g of a side wall 81-7 of a case 80-7, there is no problem in terms of design and there is no danger that the film sheet 20-7 will peel off the nameplate 30-7. Accordingly, no problems arise even if there is some dimensional error in the thickness of the push-button switch 1-7. This means that especially strict measures need not be taken to deal with assembly errors in the thickness direction of the push-button switch 1-7. This facilitates operability and fabrication as well.

Further, the underside of the frame 40-7 is provided with a stepped portion 41-7 in this embodiment. Thus, the outer peripheral portion of the switch substrate 60-7 need only be engaged with the stepped portion 41-7, thereby facilitating positioning and fixing of the switch substrate.

Figure 19:
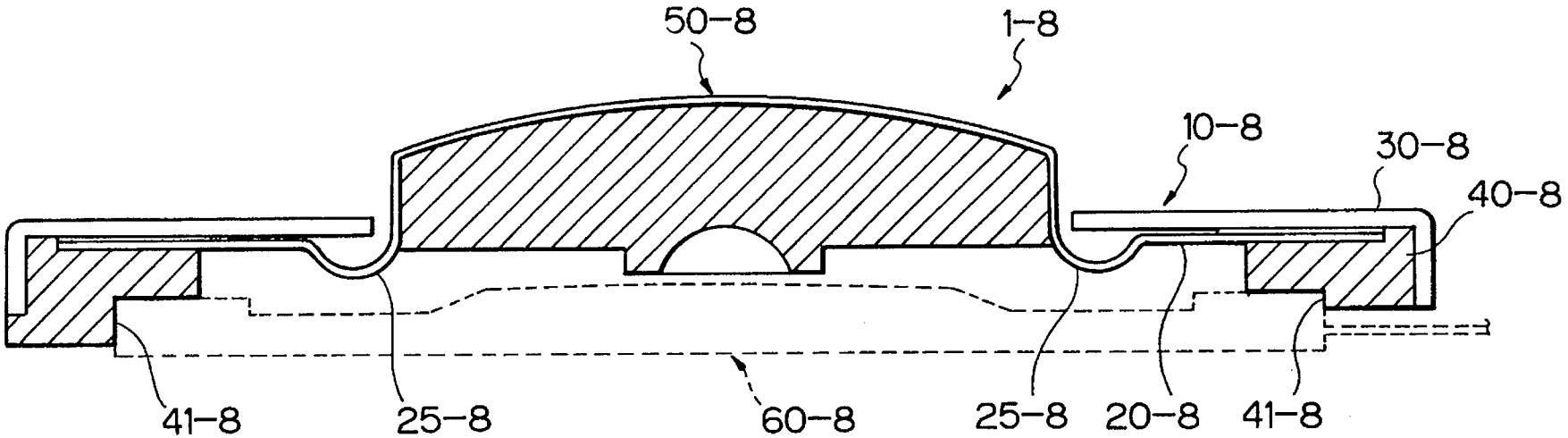
FIG. 19 is a side sectional view illustrating a push-button switch including a keytop sheet formed according to an eighth embodiment of the present invention.
Figures 20A, 20B:
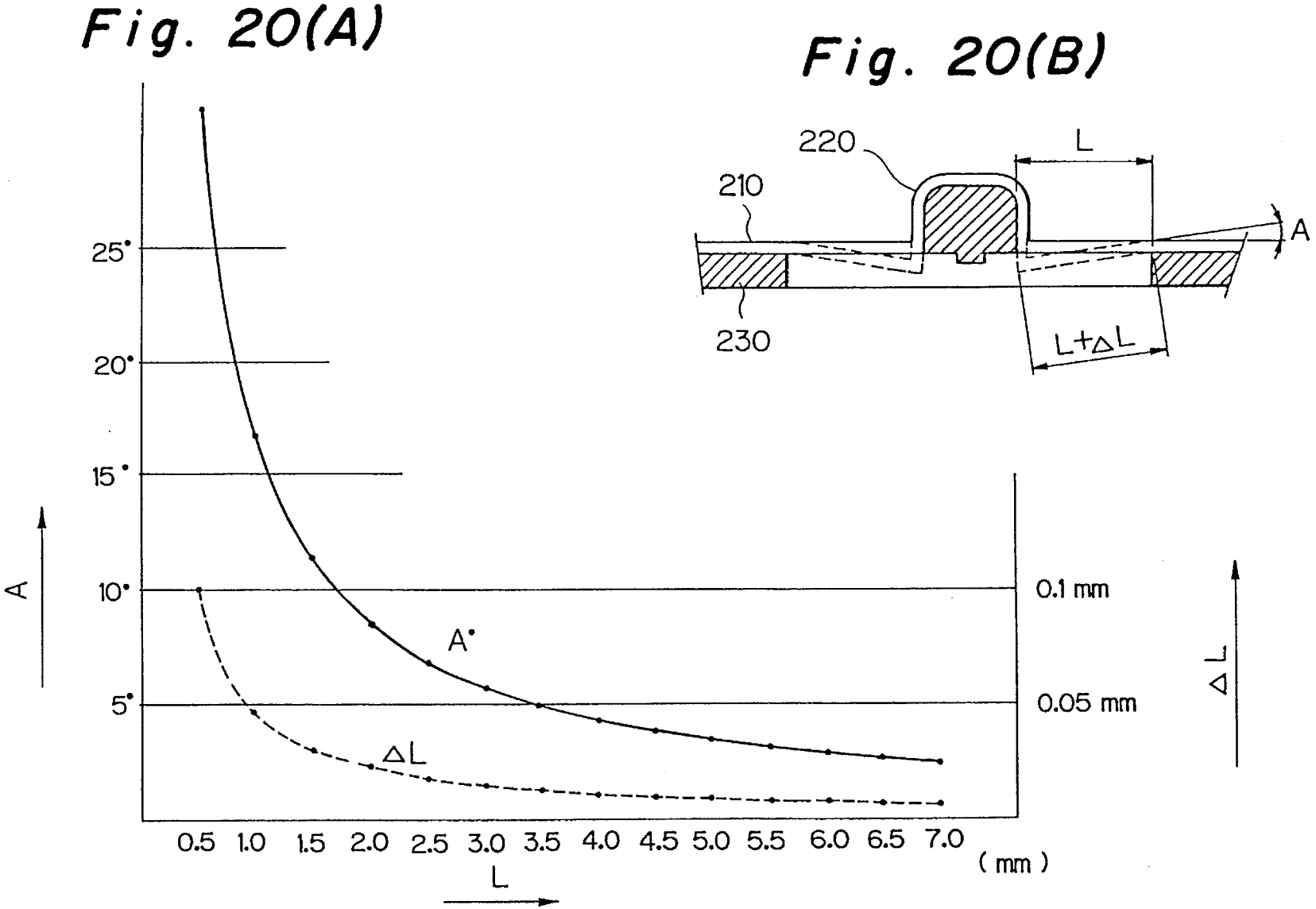
FIGS. 20(A) and 20(B) respectively are a graph and a section showing the relationship among an angle of inclination A of a film sheet, L and ΔL, where L represents the spacing between a keytop and a frame to which a film sheet has been affixed, and ΔL represents the amount by which the film sheet must stretch when the keytop is depressed by 0.3 mm.

FIG. 19 is a side sectional view illustrating a push-button switch 1-8 including a keytop sheet 10-8 formed according to an eighth embodiment of the present invention. The keytop sheet 10-8 includes a film sheet 20-8 the center of which is provided with a keytop 50-8. A frame 40-8 is attached to the outer periphery of the underside of the film sheet 20-8, and the portion of the film sheet 20-8 surrounding the keytop 50-8 is provided with a downwardly protruding curved projection 25-8. Further, a nameplate 30-8 is affixed to the top of the film sheet 20-8. In this respects the structure is the same as that of the keytop sheet 10-2 shown in FIG. 5. In addition, a portion of the nameplate 30-8 that projects beyond the film sheet 20-8 is bent and fixed to the side face of the frame 40-8, and a stepped portion 41-8 is provided on the underside of the frame 40-8. In these respects the structure is the same as that of the seventh embodiment illustrated in FIG. 16. The effects of this embodiment are a combination of the effects of the arrangements shown in FIGS. 5 and 16.

As many apparently widely different embodiments of the present invention can be provided without departing from the spirit and scope thereof, it is to be understood that the invention is not limited to the specific embodiments thereof except as defined in the appended claims.

We claim:

1. A method of producing a keytop sheet for a push-button switch, said method comprising:

positioning within a mold a flexible film sheet and a flexible nameplate sheet having an outer dimension greater than that of said film sheet, with said nameplate sheet positioned over said film sheet and having an outer peripheral portion extending outwardly beyond an outer peripheral portion of said film sheet, and with said outer peripheral portion of said nameplate sheet being bent transversely and confronting an internal surface of said mold;

injecting molten resin into said mold against a side of said bent outer peripheral portion of said nameplate sheet opposite said internal surface of said mold, thereby urging said bent outer peripheral surface of said nameplate sheet toward said internal surface of said mold, and against a side of said outer peripheral portion of said film sheet opposite said nameplate sheet; and solidifying said molten resin and thereby forming a solid frame that is fixed to said outer peripheral portion of said film sheet and that has an outer peripheral side face having affixed thereto said bent outer peripheral portion of said nameplate sheet.

2. A method as claimed in claim 1, further comprising removing from said mold said frame and affixed nameplate sheet and film sheet.

3. A method as claimed in claim 1, wherein said mold has therein a cavity, and said outer peripheral portion of said film sheet and said outer peripheral portion of said nameplate sheet are positioned within said cavity.

4. A method as claimed in claim 1, wherein said nameplate sheet has an opening therethrough at a position inwardly of said outer peripheral portion thereof, with a keytop portion of said film sheet confronting said opening, and further comprising injecting further molten resin into said mold against said keytop portion at a side of said film sheet opposite said nameplate sheet and thereby deforming said keytop portion through said opening into a cavity in said mold, and solidifying said further molten resin and thereby forming a solid keytop that is fixed to said deformed keytop portion of said film sheet.

5. A method as claimed in claim 1, wherein said film sheet is of a resin material.

6. A method as claimed in claim 1, wherein said nameplate sheet is of a resin material.

* * * * *